United States Patent [19]

Caveney et al.

[11] Patent Number: 4,688,302

[45] Date of Patent: Aug. 25, 1987

[54] ONE-PIECE CABLE TIE

[75] Inventors: Jack E. Caveney, Chicago; Roy A. Moody, Flossmoor, both of Ill.

[73] Assignee: Panduit Corp., Tinley Park, Ill.

[21] Appl. No.: 814,012

[22] Filed: Apr. 7, 1969

[51] Int. Cl.[4] ..... B65D 63/10

[52] U.S. Cl. ..... 24/16 PB; 248/74.2

[58] Field of Search ..... 24/73.7, 16 PB, 30.5 PB; 248/68, 74, 74.2

[56] References Cited

U.S. PATENT DOCUMENTS

| | | | |
|---|---|---|---|
| 2,936,980 | 5/1960 | Rapata | 248/74 PB |
| 2,969,216 | 1/1961 | Hallsey | 24/16 PB X |
| 2,977,145 | 3/1961 | Rifkin | 24/16 PB X |
| 3,009,220 | 11/1961 | Fein | 24/16 PB |
| 3,127,648 | 4/1964 | Emery | 24/16 PB |
| 3,214,808 | 11/1965 | Litwin | 24/16 PB |
| 3,339,246 | 9/1967 | Geisinger | 24/16 PB |
| 3,368,247 | 2/1968 | Orban | 24/16 PB |
| 3,471,109 | 10/1969 | Meyer | 248/68 |
| 3,486,201 | 12/1969 | Bourne | 24/16 PB |

*Primary Examiner*—William E. Lyddane

*Attorney, Agent, or Firm*—Charles R. Wentzel; Mark D. Hilliard

[57] ABSTRACT

An integral one-piece cable tie including an elongated flexible strap having a row of teeth thereon, a frame integral with one end of the strap and having an abutment wall and an entry surface and an exit surface and a strap-receiving opening extending therethrough, a pawl pivotally mounted by a hinge within the opening and having a set of teeth thereon shaped complementary to the row of teeth, wedging surfaces on the facing portions of the frame and the pawl, the thickness of the hinge being less than the thickness of the strap so as to accommodate sliding movement of the pawl toward the entry surface with the wedging surfaces in contact, thereby to move the set of teeth toward the abutment wall to grip the strap therebetween.

9 Claims, 21 Drawing Figures

ONE-PIECE CABLE TIE

The present invention is directed to an integral one-piece cable tie to be tensioned about a bundle of wires and the like.

It is an object of the invention to provide an integral one-piece cable tie to be tensioned about a bundle of wires and the like comprising an elongated flexible strap having a row of teeth disposed on one longitudinal surface thereof, a frame integral with one end of the strap and including an abutment wall and having an entry surface and an exit surface and a strap-receiving opening therethrough, a pawl disposed within the frame in the strap-receiving opening, a hinge interconnecting the frame and the end of the pawl disposed toward the entry surface, the thickness of the hinge being less than the thickness of the strap to accommodate ready movement of the pawl with respect to the frame, the abutment wall having a strap-bearing surface disposed toward the pawl and defining therewith a strap-receiving throat, and a set of teeth on the pawl disposed toward the abutment wall and shaped complementary to the row of teeth on the strap, the strap being deformable into a loop encircling a bundle of wires with the other end of the strap extending into the strap-receiving throat and through the opening in the frame and therebeyond, the set of teeth being disposed toward the row of teeth and engageable with successive ones thereof as the strap is tightened about the bundle of wires to a tensioned condition, any force tending to withdraw the strap from within the strap-receiving throat in a strap-loosening direction serving to move the set of teeth into more firm engagment with the engaged ones of the row of teeth firmly to grip the strap between the strap-bearing surface and the pawl, whereby to prevent inadvertent withdrawal of the strap from the frame and thus to lock the strap in its tensioned condition about the bundle of wires.

Another object of the invention is to provide a cable tie of the type set forth wherein there is provided a wedging surface on the frame opposite the abutment wall and a wedging surface on the pawl disposed adjacent to the frame wedging surface, the hinge and the wedging surfaces being arranged to accomodate sliding movement of the pawl toward the entry surface with the wedging surfaces in contact, thereby to move the set of teeth toward the strap-bearing surface.

Yet another object of the invention is to provide a cable tie of the type set forth wherein the crests of the teeth in the set of teeth all lie in a common surface that is disposed substantially equidistant from the strap-bearing surface in the as-molded position of the pawl.

Still another object of the invention is to provide a cable tie of the type set forth wherein the frame has a channel on the entry side thereof through the abutment wall for receiving the other end of the strap, the channel permitting the frame to lie more nearly flush against an associated bundle.

Another object of the invention is to provide a cable tie of the type set forth wherein the frame includes an end wall opposite the abutment wall, the end wall being relatively thicker adjacent to the entry surface and being relatively thinner adjacent to the exit surface, the hinge interconnecting the pawl to the frame being disposed adjacent to the entry surface of the frame at the thicker portion of the end wall.

Still another object of the invention is to provide a cable tie of the type set forth wherein the frame has a strap-guiding surface thereon adjacent to the entry surface thereof and disposed toward the strap for guiding the free end of the strap into the strap-receiving throat.

Another object of the invention is to provide a cable tie of the type set forth wherein there is provided a stop integral with the frame adjacent to the juncture of the hinge therewith for limiting movement of the hinge in a direction toward the entry surface.

Still another object of the invention is to provide a cable tie of the type set forth wherein rails are respectively disposed on side walls provided on the frame and extend into the strap-receiving opening in positions to guide the strap along a path adjacent to the strap-bearing surface.

Another object of the invention is to provide a cable tie of the type set forth wherein the crest-to-crest distance of the set of teeth is slightly less than the crest-to-crest distance of the row of teeth so that when the tooth in the set of teeth disposed toward the entry surface is the first to engage one of the row of teeth, all the teeth in the set of teeth will ultimately engage teeth in the row of teeth.

A further object of the invention is to provide a cable tie of the type set forth wherein the teeth are of the buttress type, i.e., one face of each tooth in the row of teeth, for example, is disposed substantially normal to the adjacent surface of the strap.

A further object of the invention is to provide a cable tie of the type set forth wherein a tab is on the abutment wall adjacent to the exit surface and extends toward the pawl, the tab urging the portion of the strap between the strap-bearing surface and the pawl into firm engagement with the pawl.

A still further object of the invention is to provide a cable tie of the type set forth wherein two spaced apart rows of gripping projections are disposed on the free end of the strap for engagement by a user during the application of the cable tie about a bundle of wires, the rows being laterally spaced apart a distance greater than the width of the pawl teeth.

A still further object of the invention is to provide a cable tie of the type set forth wherein a transversely extending ridge is on the surface of the strap opposite the teeth and is engageable with the frame temporarily to hold the strap about a bundle of wires during the assembly of the cable tie about the bundle of wires.

Further features of the invention pertain to the particular arrangement of the parts of the cable tie, whereby the above-outlined and additional operating features thereof are attained.

The invention, both as to its organization and method of operation, together with further objects and advantages thereof, will best be understood by reference to the following specification taken in connection with the accompanying drawings, in which.

Figure 9:
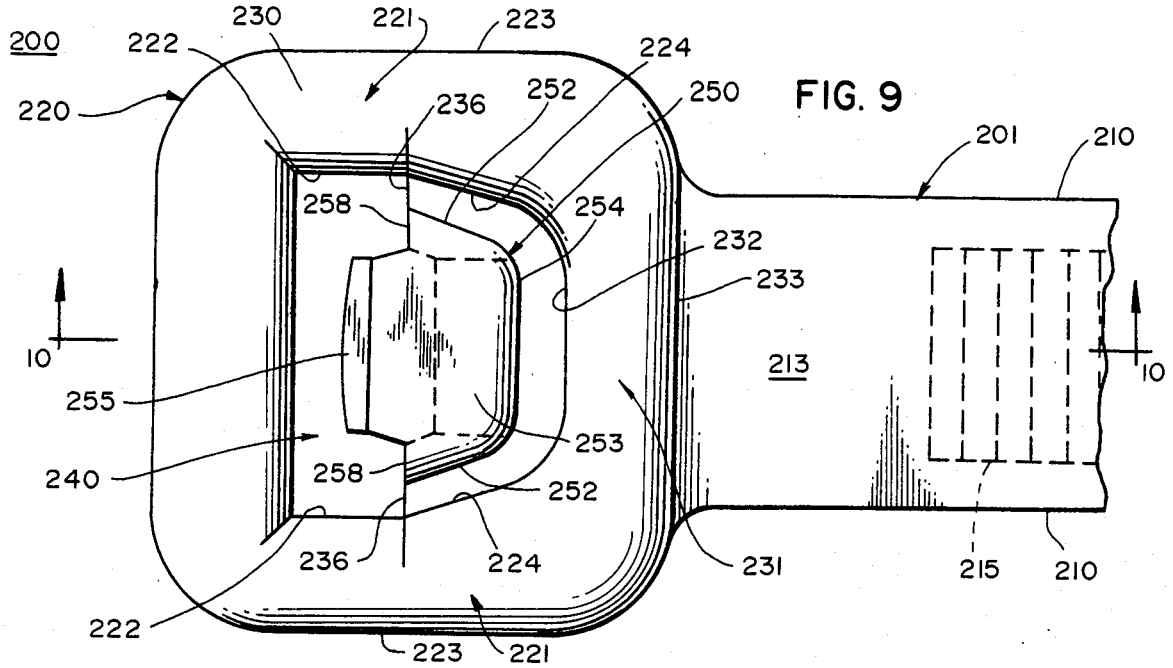
Figure 10:
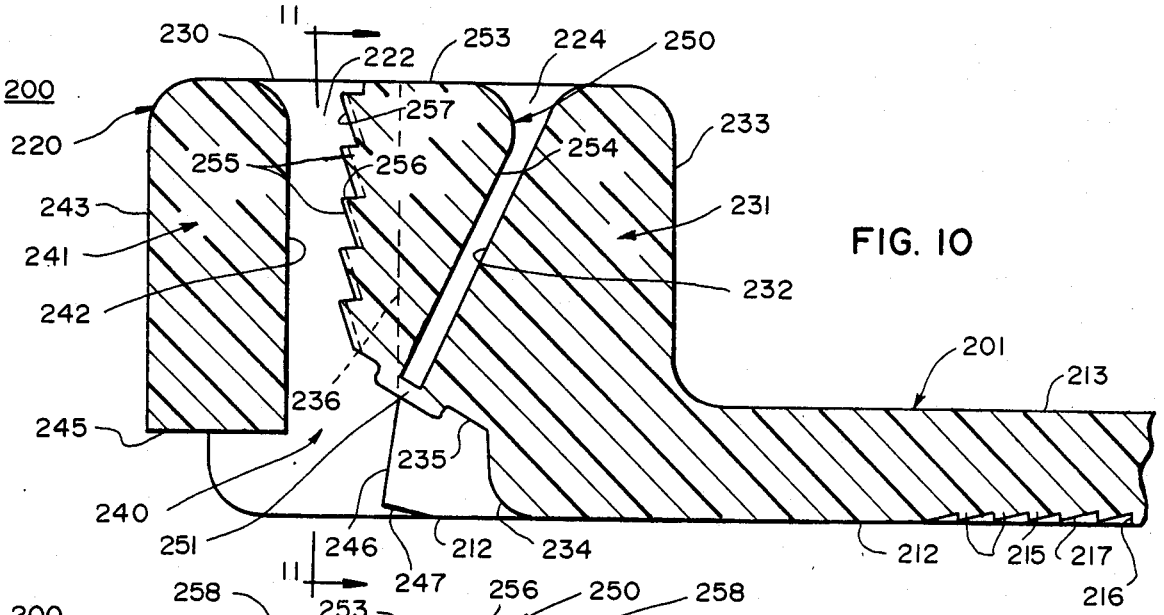
Figure 11:
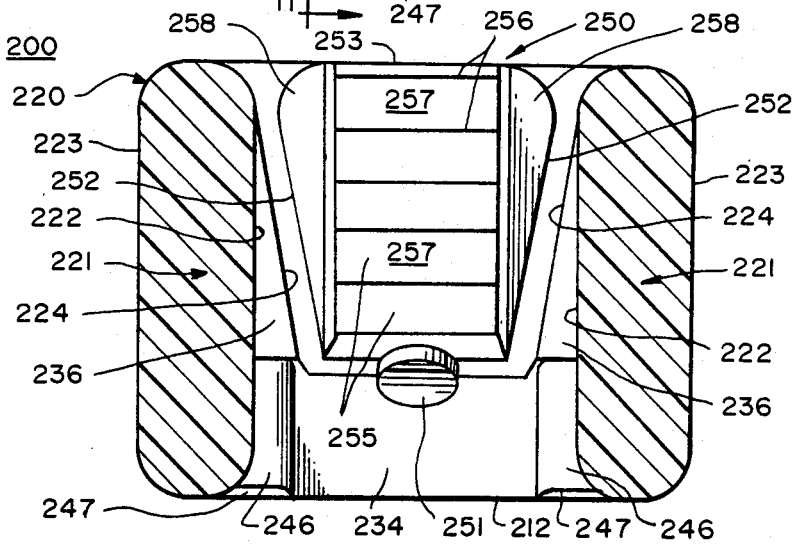
Figure 12:
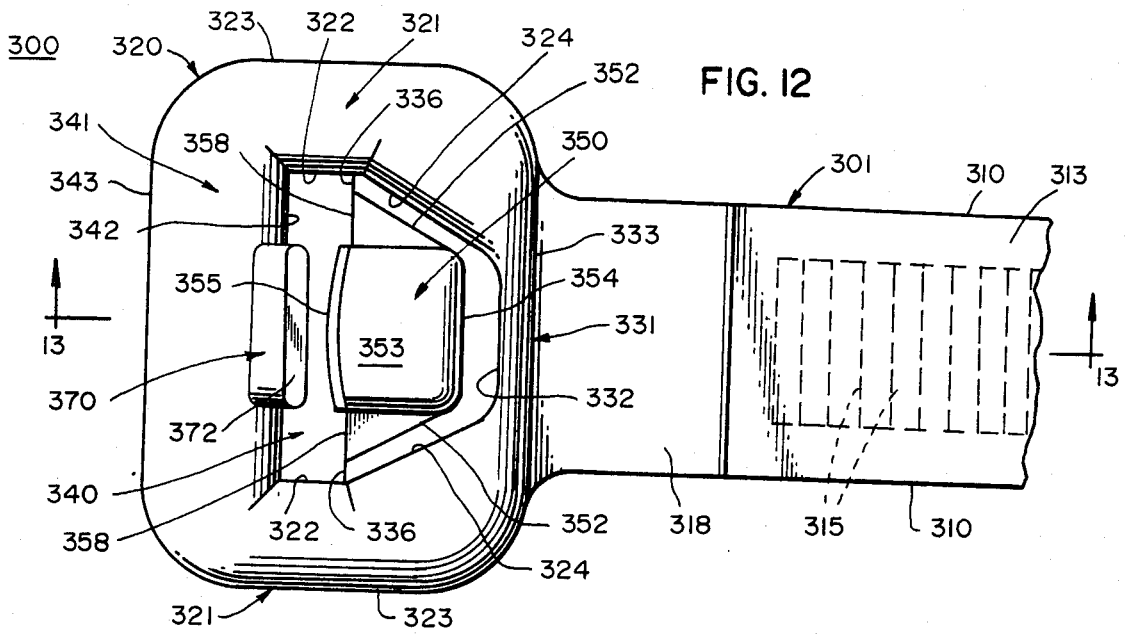
Figure 13:
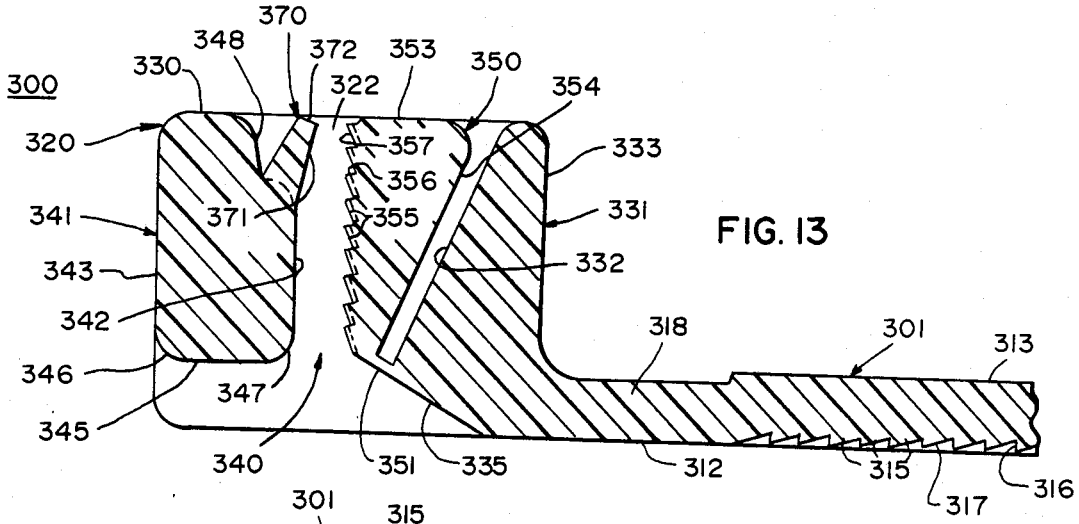
Figure 14:
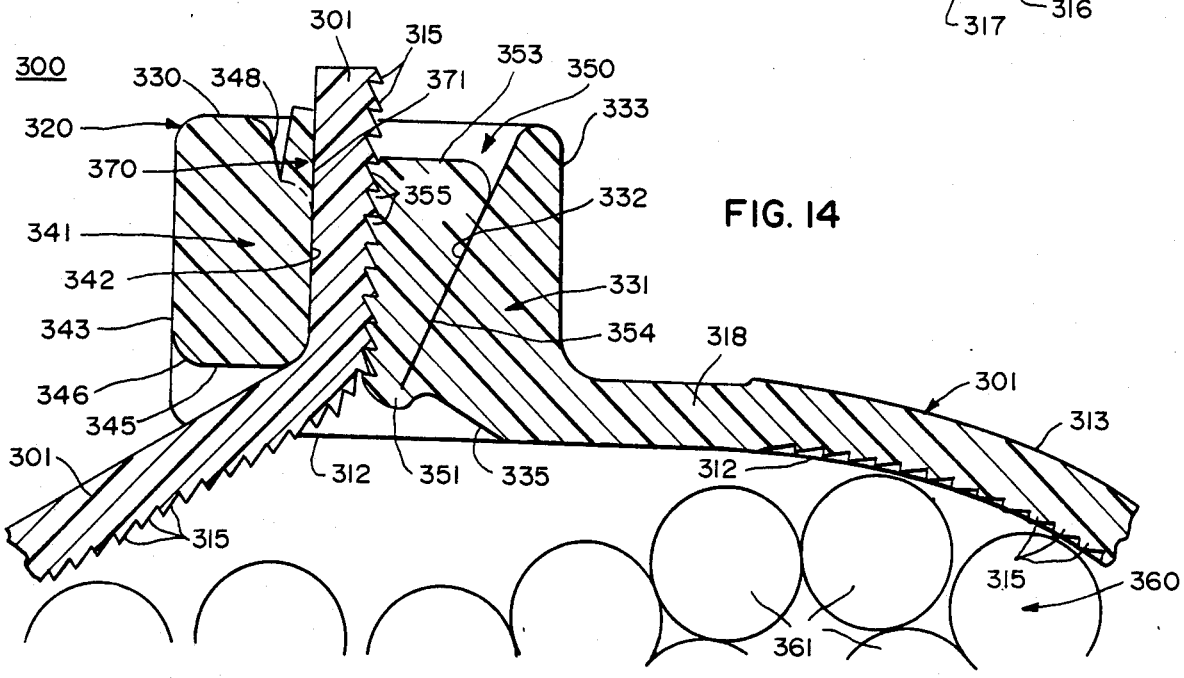
Figure 15:
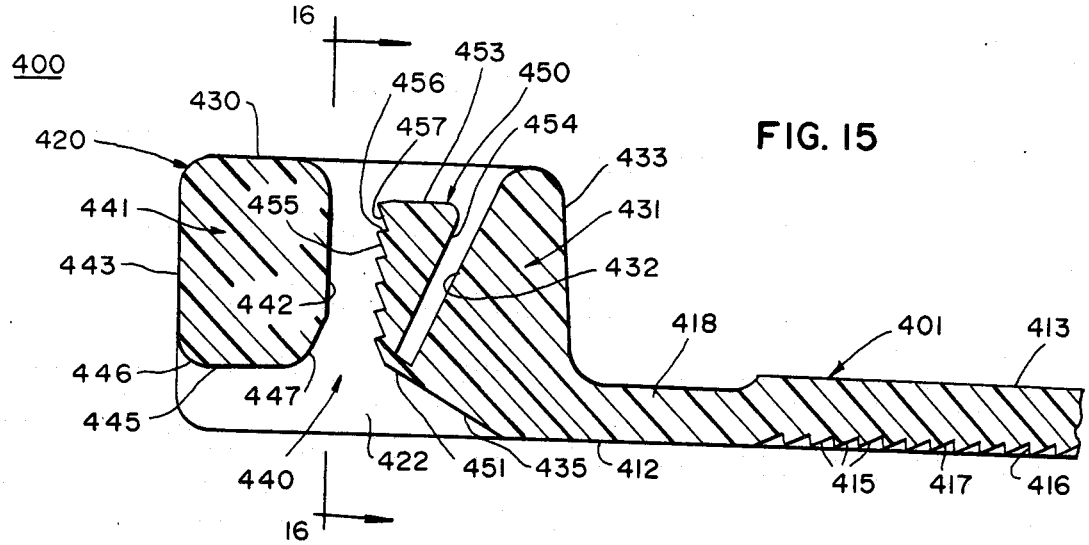
Figure 16:
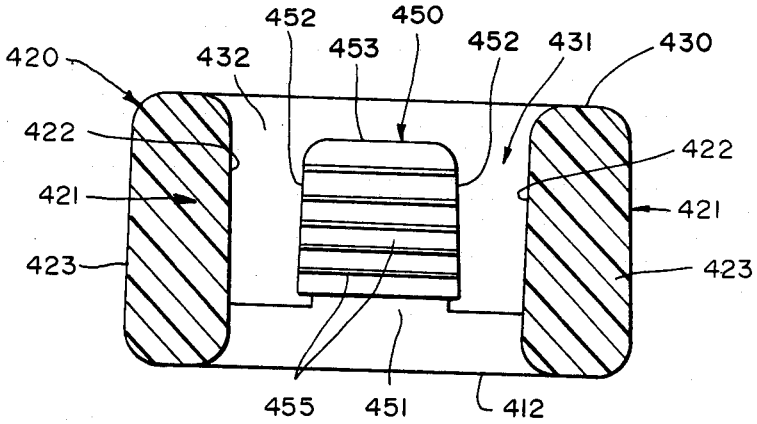
Figure 17:
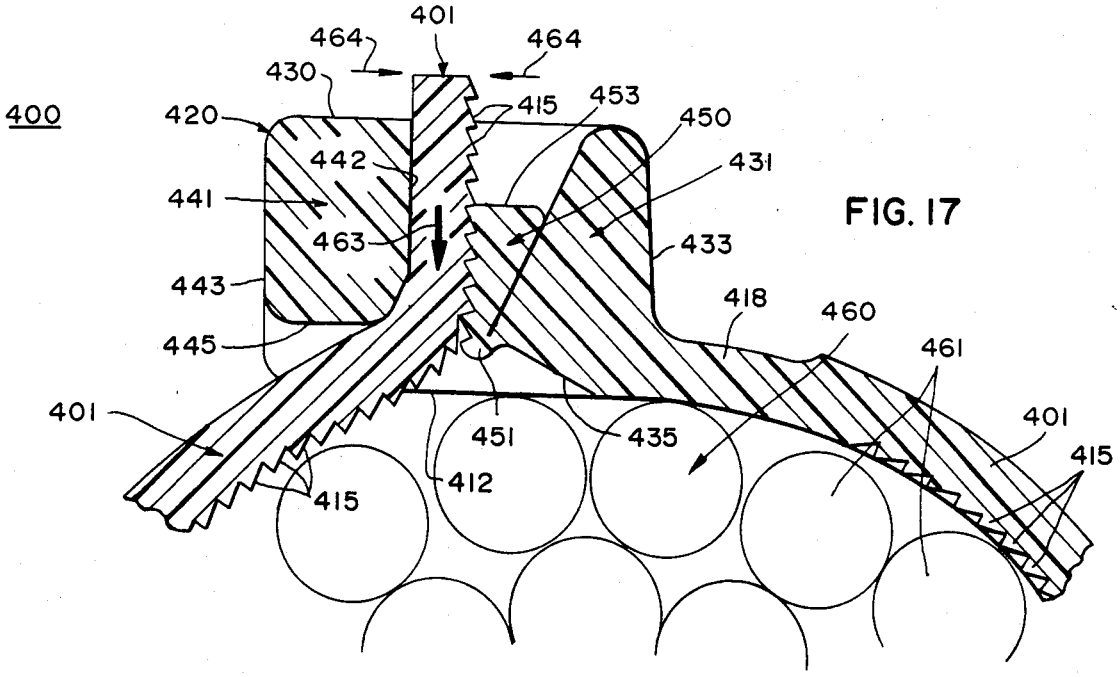
Figure 18:
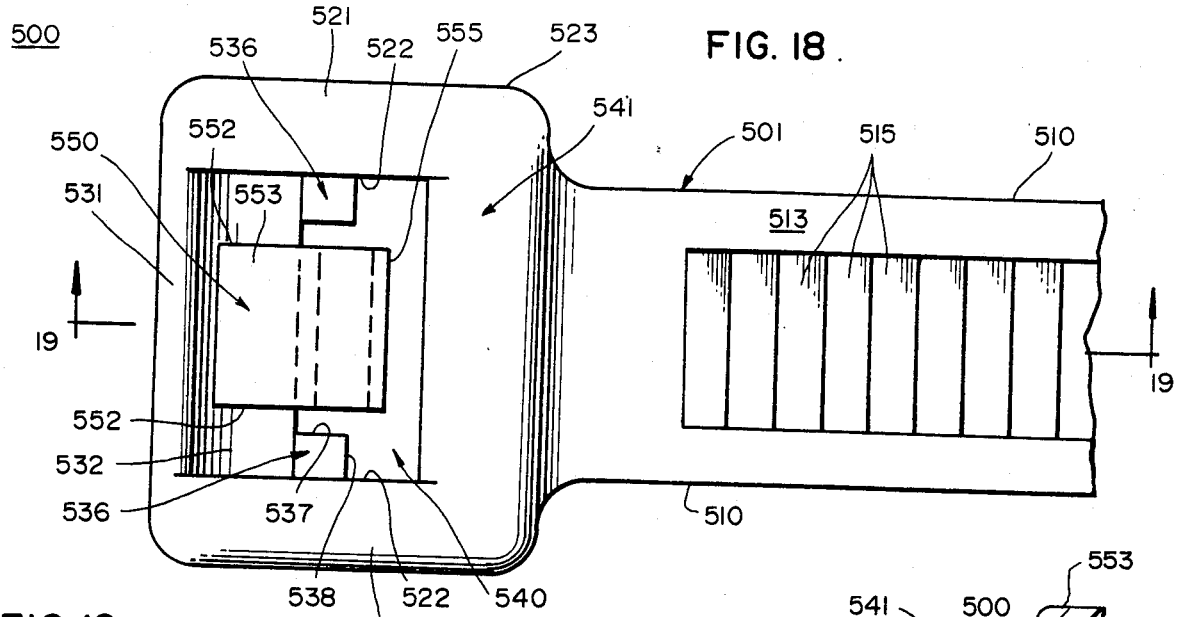
Figure 19:
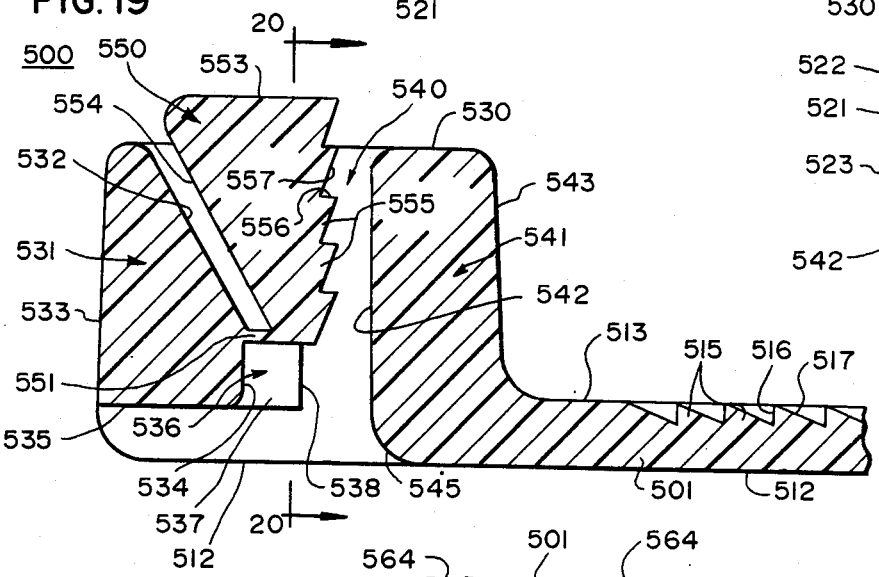
Figure 20:
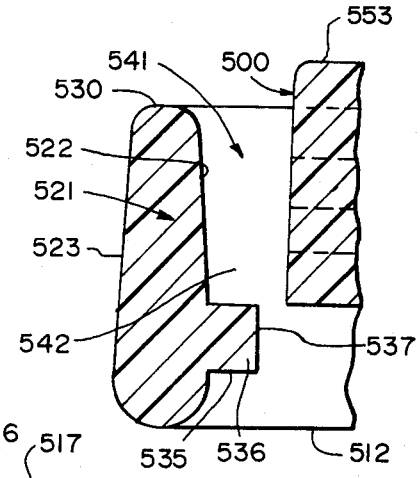
Figure 21:
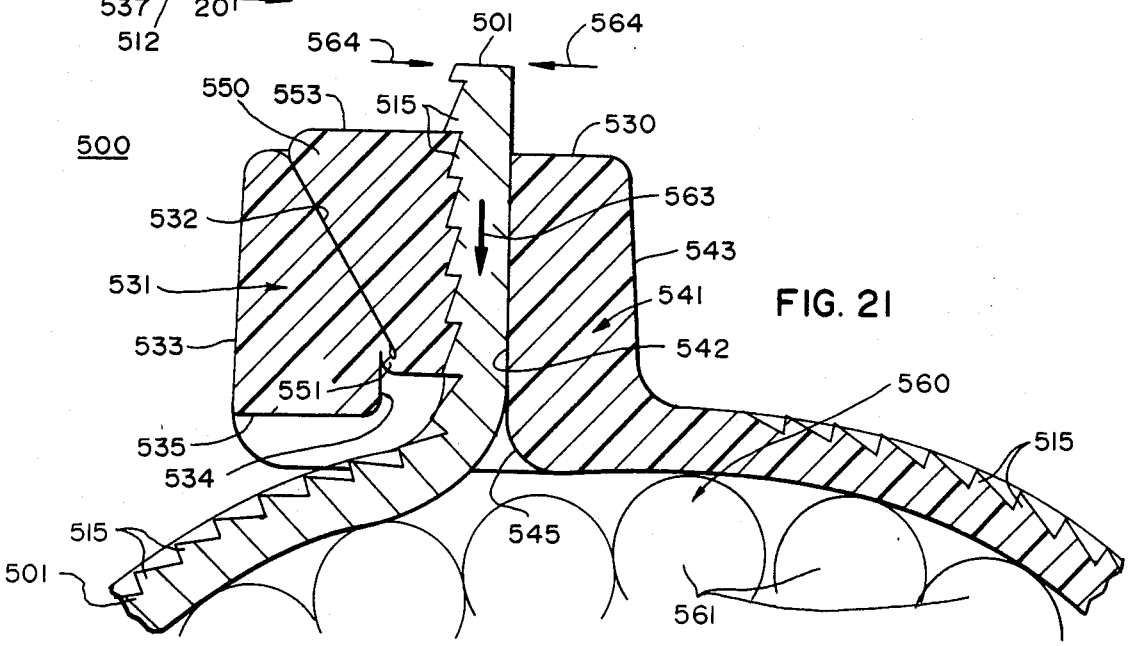

FIGS. 5 to 8, inclusive, are diagrammatical views illustrating an application of the cable tie of FIGS. 1 to 4 about a bundle of wires;

FIG. 9 is a fragmentary view of the frame end of a second preferred embodiment of a cable tie of the present invention;

FIG. 10 is a view in vertical section along the line 10—10 of FIG. 9;

FIG. 11 is a view in transverse section along the line 11—11 in FIG. 10;

FIG. 12 is a fragmentary view of the frame end of a third preferred embodiment of a cable tie of the present invention;

FIG. 13 is a view in vertical section along the line 13—13 of FIG. 12;

FIG. 14 is a fragmentary view in vertical section showing the cable tie of FIGS. 12 and 13 in the operative position about a bundle of wires;

FIG. 15 is a view in vertical section along the longitudinal centerline of a fourth embodiment of a cable tie made in accordance with the present invention;

FIG. 16 is a view in transverse section along the line 16—16 of FIG. 15;

FIG. 17 is a fragmentary view in longitudinal section showing the cable tie of FIGS. 15 and 16 in the operative position about a bundle of wires;

FIG. 18 is a fragmentary top elevational view of the head end of a fifth embodiment of a cable tie made in accordance with the present invention;

FIG. 19 is a view in vertical section along the line 19—19 of FIG. 18;

FIG. 20 is a fragmentary view in transverse section along the line 20—20 of FIG. 19; and FIG. 21 is a fragmentary view in longitudinal section showing the cable tie of FIGS. 18 to 20 in the operative position about a bundle of wires.

Figure 1:
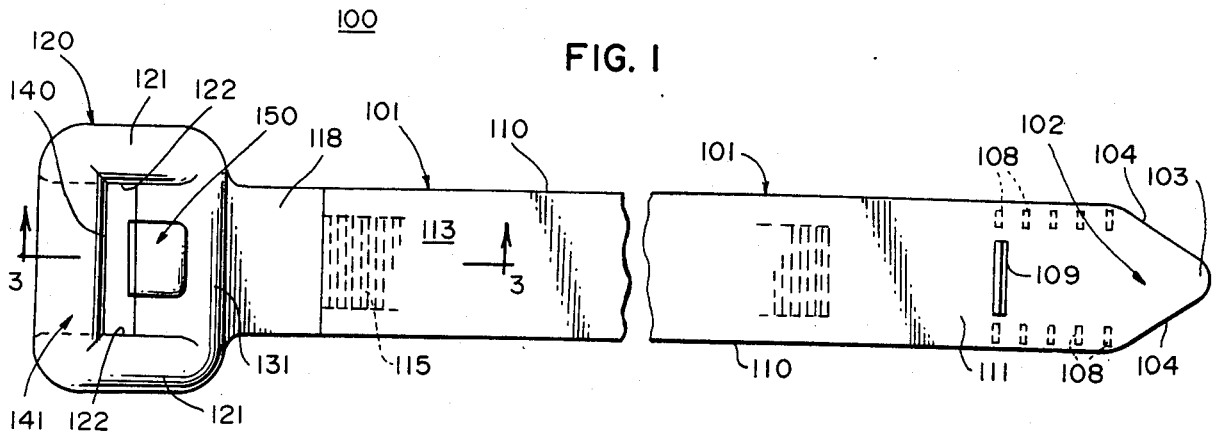
FIG. 1 is a plan view with certain parts broken away of a first embodiment of an integral one-piece cable tie made in accordance with and embodying the principles of the present invention.
Figure 2:
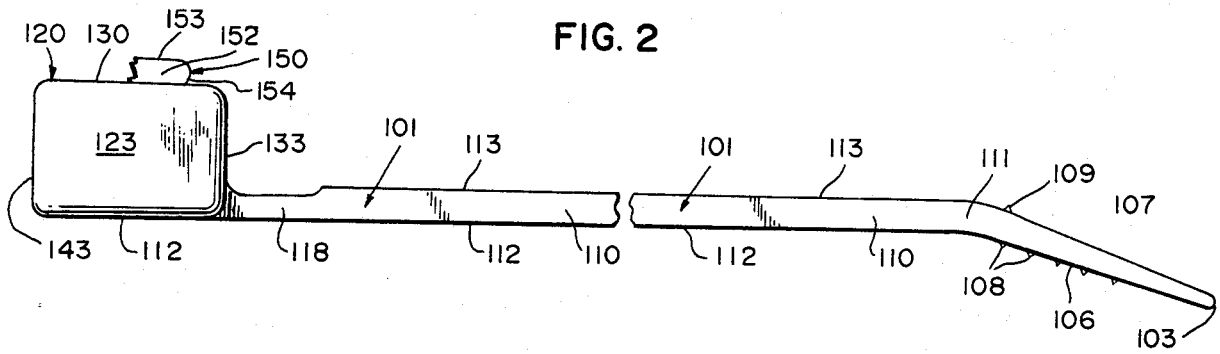
FIG. 2 is a side elevational view of the cable tie of FIG. 1.

Referring first to FIGS. 1 and 2 of the drawings, there is shown an integral one-piece cable tie 100 made in accordance with and embodying the principles of the present invention. The cable tie 100 includes generally a strap 101 carrying on one end thereof a frame or head 120 having a strap-receiving opening or throat 140 therethrough in which is disposed a pawl 150. The cable tie 100 is typically used to bind a bundle 160 formed of a plurality of wires 161, and accordingly, the cable tie 100 has been illustrated in this end use in FIG. 7; however, it will be appreciated that the cable tie 100 may be advantageously used to bind other objects in a like manner.

The preferred material of construction of the cable tie 100 is a suitable synthetic organic plastic resin, the preferred resin being one of the polyamide resins, the resin must be sufficiently flexible to permit deformation of the several parts of the cable tie 100 as illustrated throughout the drawings. It is an important feature of the present invention that each of the parts of the cable tie 100 is integral with the adjacent parts thereof, whereby the cable tie 100 is truly one-piece and formed integral throughout.

The strap 101 is elongated and flexible and includes an outer end 102 that is deflected downwardly as viewed in FIG. 2 with respect to the remaining portion of the strap 101, the outer end 102 carrying thereon a tip 103 provided with tapered sides 104. The outer end 102 further has an inner or bundle-engaging surface 106 and an outer surface 107, the inner surface 106 carrying a plurality of transversely spaced-apart pairs of gripping projections 108 equidistantly spaced along the length of the outer end 102. A high ridge or detent 109 is provided on the outer surface 107 and is arranged transversely with respect thereto and adjacent to the juncture 111 between the outer end 102 and the remaining portion of the strap 101. In use, the detent 109 is caused to engage the strap 101 on the frame 120 temporarily in an encircling position with respect to an associated bundle 160, all as will be explained more fully hereinafter.

The strap 101 further includes a pair of longitudinally extending strap sides 110 which extend the length of the strap 101, and there is provided on the portion of the strap 101 disposed between the juncture with the outer end 102 and the juncture with the frame 120 an inner or bundle-engaging surface 112 and an outer surface 113. Disposed in the surface 112 is a row of abutments or teeth 115, the teeth 115 being disposed in a recessed position with respect to the surface 112 and extending laterally of the strap 101 and having a length slightly less than the width of the surface 112, whereby to be confined completely within the body of the strap 101. As illustrated, each of the teeth 115 has a shorter side 116 disposed substantially normal to the adjacent surface 112 and a longer or inclined side 117, see particularly FIG. 3.

The frame 120 is integral with the strap 101 and comprises a pair of side walls or members 121, a rear wall or member 131 and a front wall or member 141. As may be best seen in FIG. 4, the side walls 121 are laterally spaced apart and include inner surfaces 122 that extend the full height of the frame 120 and are disposed essentially parallel to one another but slightly diverging upwardly, the inner surfaces 122 more specifically extending from the inner surface 112 which serves as an entry surface for the frame 120 to an exit surface 130 on top of the frame 120 as viewed in FIG. 4. The inner surfaces 122 further are spaced apart a distance slightly greater than the lateral distance between the strap sides 110, whereby the strap 101 may be received between the inner surfaces 122, all as will be explained more fully hereinafter. Each of the side walls 121 further includes an outer surface 123 that extends downwardly and outwardly from the exit surface 130 to the entry surface 112.

Figure 3:
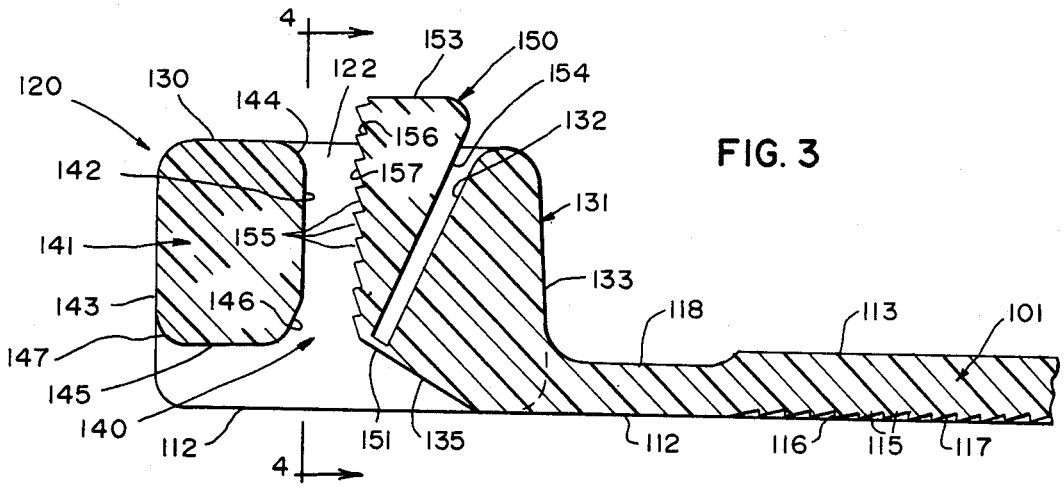
FIG. 3 is a fragmentary view in vertical section on an enlarged scale along the line 3—3 of FIG. 1.

The rear wall or end wall 131 includes an inner surface 132 and an outer surface 133, the inner surface 132 diverging downwardly away from the outer surface 133 from the exit surface 130 toward the entry surface 112, whereby the rear wall 131 is thicker at the bottom thereof as illustrated in FIG. 3 than at the top thereof. Extending between the side walls 121 and adjacent to the entry surface 112 is an upwardly inclined guide surface 135, the guide surface 135 joining the inner surface 132 on either side of the pawl 150. As is best seen in FIG. 3, the strap 101 is joined to the frame 120 at the lower and thicker portion of the end wall 133 by a hinge section 118 having a smaller thickness than the strap 101, whereby to facilitate ready bending of the strap 101 with respect to the frame 120. The inclined guide surface 135 serves to guide the tip 103 of the strap 101 into the opening 140 in the frame 120 as will be described more fully hereinafter.

The front wall or abutment wall 141 has an inner surface 142 which is spaced from the rear wall 131 in the direction opposite to the strap 101, the inner surface 142 being disposed substantially normal to the entry surface 112 and the longitudinal axis of the strap 101 as-molded, and forming with the inner surface 132 a strap-receiving opening. The front wall 141 also has an outer surface 143 which extends from the entry surface 112 to the exit surface 130 of the frame 120. A strap-receiving channel is provided in the frame 120 through the front wall 141 and is defined by a lower surface 145 on the front wall 141 and the inner surfaces 122 on the side walls 121. A rounded surface 144 joins the inner surface 142 and the exit surface 130 while the inclined surface 146 joins the lower edge of the inner surface 142 and the lower surface 145. The surface 145 is joined by a rounded surface 147 to the outer surface 143. The channel provided through the front wall 141 permits the frame 120 to lie more closely against the associated bundle 160 when the parts are in the tensioned condition as illustrated in FIG. 7.

Mounted within the strap-receiving opening 140 in the frame 120 is the pawl 150, a hinge 151 of limited cross section serving integrally to interconnect the lower end of the pawl 150 to the rear wall 131 at the thicker portion thereof. The pawl 150 has a pair of side surfaces 152 that converge slightly upwardly, the side surfaces 152 being spaced apart a distance slightly less than the transverse dimensions of the teeth 115 on the strap 101. The pawl 150 also has a top surface 153 (see FIG. 4) and a rear surface 154 disposed toward the inner surface 132 and shaped complementary thereto, the surfaces 132 and 154 cooperating to provide sliding wedging surfaces as will be explained more fully hereinafter.

Figure 4:
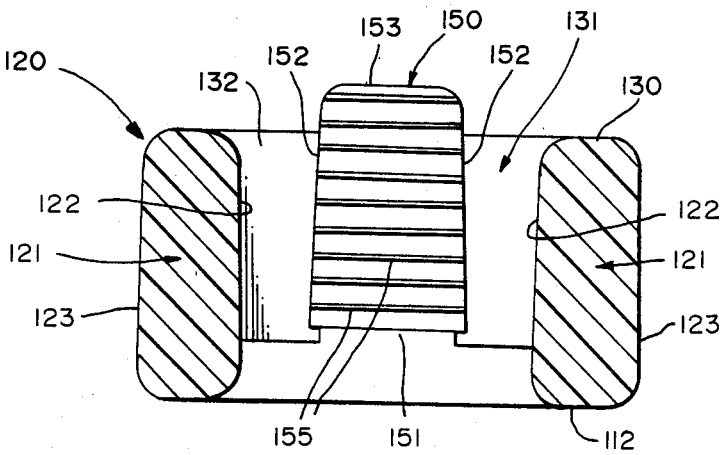
FIG. 4 is a view in transverse section along the line 4—4 of FIG. 3.

A set of teeth 155 is provided on the surface of the pawl 150 disposed toward the inner surface 142, the teeth 155 having a shorter side 156 and a longer side 157. The shorter sides 156 are disposed substantially normal to the inner surface 142 and parallel to the entry surface 112 when in the as-molded condition as illustrated in FIGS. 3 and 4. As molded, the pawl 150 is in the position illustrated in FIGS. 3 and 4, and it will be noted that the crests of the teeth 155 all lie in a common plane that is essentially parallel to the opposed inner surface 142 on the front wall 141; and the roots of the teeth 155 of the pawl 150 also lie in a common plane substantially parallel to the inner surface 142. Furthermore, the crest-to-crest distance on the pawl teeth 155 is slightly less than the crest-to-crest distance on the strap teeth 115, whereby to insure that all of the teeth 155 on the pawl 150 engage with teeth 115 on the strap 101 as will be explained more fully hereinafter.

Figure 7:
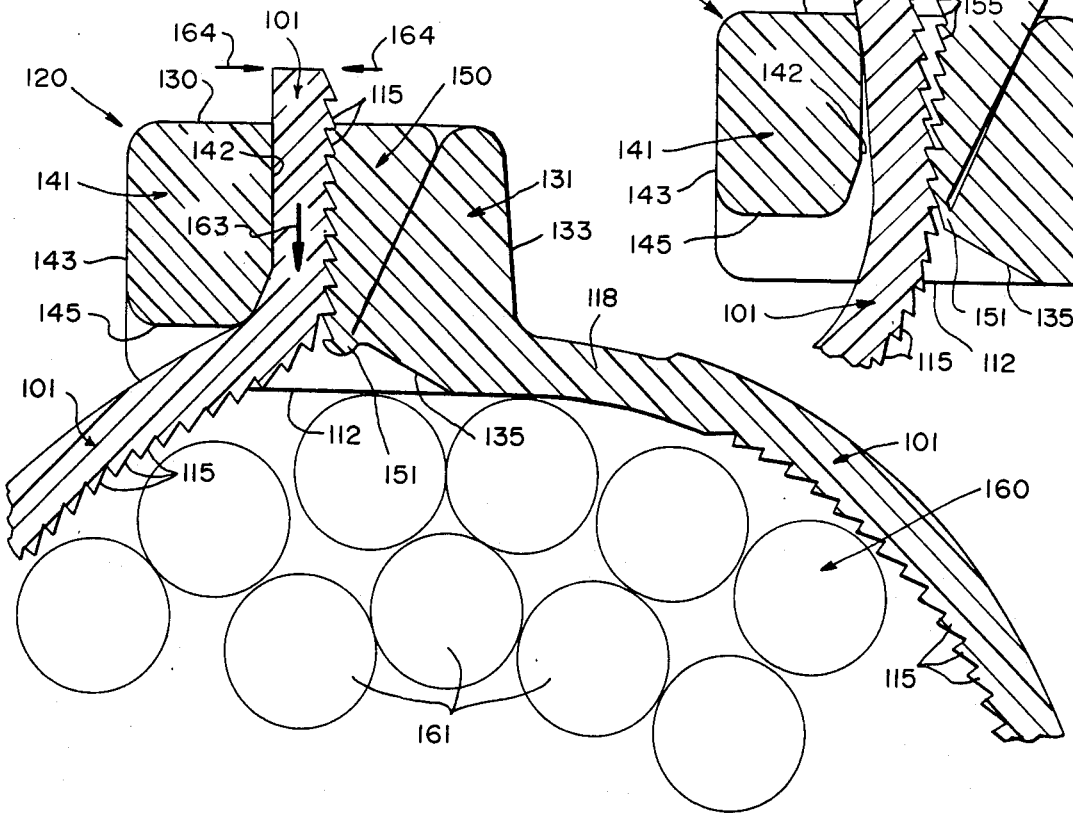

In use, the cable tie 100 is encircled about a bundle 160 of wires 161 as illustrated in FIG. 7, in order firmly to hold the wires 161 in the assembled condition. The frame 120 and the several parts associated therewith including the pawl 150 are shown in FIG. 3 in the as-molded condition and prior to the insertion thereinto of the outer end 102 of the strap 101, and specifically the tip 103 thereof. It will be noted that the crests of the teeth 155 lie in a plane that is essentially parallel to the inner surface 142 of the front wall 141.

Figure 5:
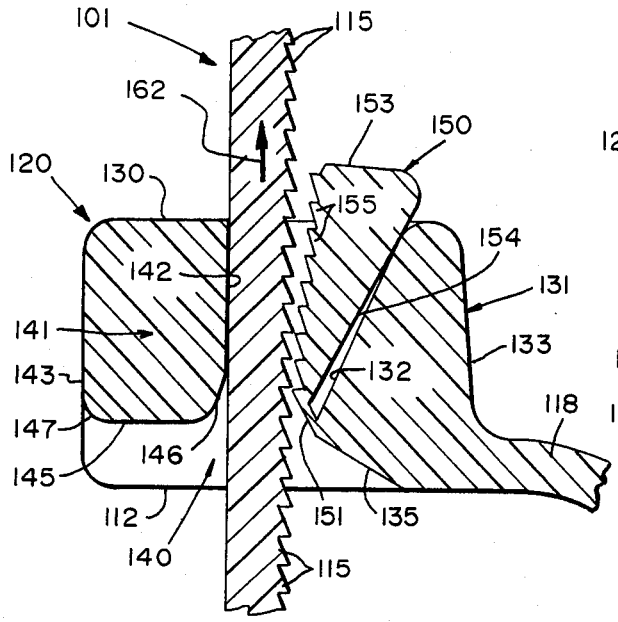

As is best illustrated in FIG. 5, initial insertion of the strap 101 into the throat 140 is aided by the inclined surface 135 and also by the channel through the front wall 141 defined by the surface 145, thereby to guide the end of the strap 101 into the throat 140. Initial engagement between the strap 101 and the pawl 150 is with the lowermost one of the teeth 155, i.e., the tooth 155 disposed toward the entry surface 112, such engagement pivoting the pawl 150 in the clockwise direction as illustrated in FIG. 5, such movement of the pawl 150 being facilitated by the hinge 151.

The detent 109 may be used temporarily to engage the front wall 141 so as temporarily to hold the strap 101 encircled about the associated bundle 160. In this manner, the workmen can continue to add wires to the bundle 160 or remove wires therefrom, as required, all before the final engagement of the strap teeth 115 with the pawl teeth 155.

Figure 6:
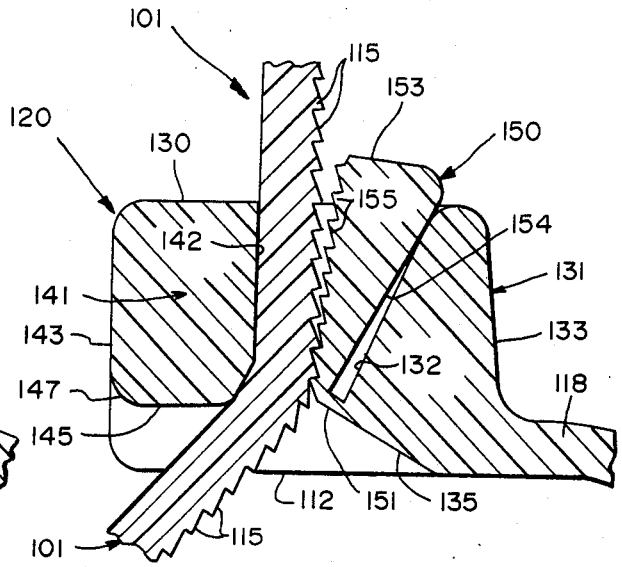

The gripping projections 108 at this time extend beyond the exit surface 130 so that the user can easily grip the projections 108 to pull the strap 101 to a position such that the teeth 115 engage the teeth 155. The rows of projections 108 are spaced apart a distance greater than the width of the teeth 155 so that the projections 108 will not engage the teeth 155 during insertion of the strap 101 into the head 120. Further tightening movement of the strap 101 is illustrated in FIG. 6, wherein it is noted that the teeth 115 on the strap 101 successively engage the lowermost one of the teeth 155 on the pawl 150 to hold the pawl 150 in the position illustrated during the tightening movement of the strap 101 through the frame 120. Preferably a tool such as that illustrated in the Caveney and Moody U.S. Pat. No. 3,169,560, granted Feb. 16, 1965, or that illustrated in the Caveney and Moody U.S. Pat. No. 3,254,680, granted June 7, 1966, is utilized to tighten the strap 101 about the bundle 160, which tool automatically at the end of the tightening operation severs the strap 101 at a point disposed beyond the exit surface 130 of the frame 120, such as is illustrated by the arrows 164 in FIG. 7.

Immediately after severing of the strap 101, the tension in the portion of the strap 101 about the bundle 160 and the tension in the bundle 160 tend to withdraw the strap 101 from the frame 120 in the direction of the arrow 163, i.e., in a retrograde or strap-withdrawal or strap-loosening direction. During such movement of the strap 101 relative to the frame 120, the tooth 115 disposed above the lowermost tooth 155 engages the lowermost tooth 155 and begins moving the pawl 150 downwardly from the position illustrated in FIG. 6 to that illustrated in FIG. 7. As the retrograde movement of the strap 101 continues, the teeth 155 above the lowermost tooth 155 progressively engage the teeth 115 of the strap 101 until all of the teeth 155 on the pawl 150 engage the adjacent ones of the teeth 115 on the strap 101. Simultaneously, the wedging surface 132 on the frame 120 and the wedging surface 154 on the pawl 150 are moved into engagement with one another and the pawl 150 slides downwardly with respect to the frame 120 to the position illustrated in FIG.7. Such movement of the pawl 150 with respect to the frame 120 is facilitated by the flexible and relatively long character of the hinge 151. Such sliding and wedging movements of the pawl 150 within the frame 120 also move the pawl 150 and the teeth 155 thereof toward the front wall 140 firmly to wedge the portion of the strap 101 disposed in the throat 140 between the front wall 141 and the pawl 150, and also firmly to press the teeth 155 on the pawl 150 into engagement with the teeth 115 on the strap 101.

The channel in the front wall 141 formed by the lower surface 145 and the inner surfaces 122 of the side walls 121 assists in the entry of the tip 103 into the throat 140 and also assists in permitting the head 120 to lie more nearly flat against the associated bundle 160. The inclined surface 135 likewise serves to guide the tip 103 of the strap 101 into the throat 140.

Figure 8:
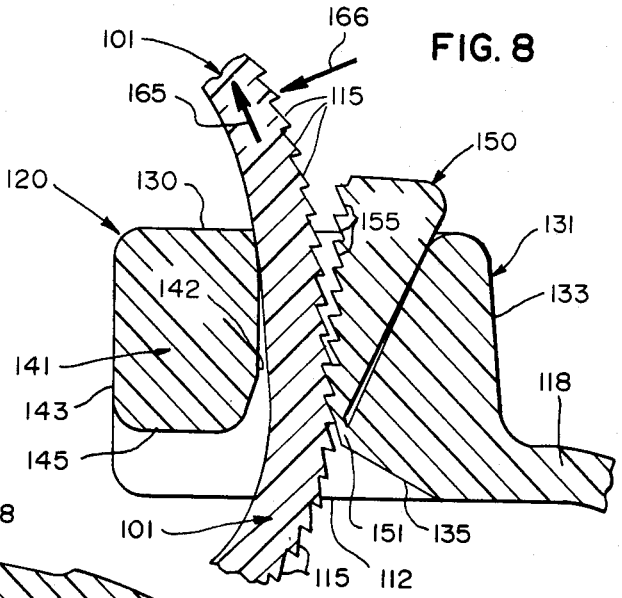

If the portion of the strap 101 extending beyond the frame 120 is not cut as illustrated at 164 in FIG. 7, then that portion of the strap 101 can be used to pull the strap 101 in the direction of the arrow 165 while forcing that portion of the strap 101 toward the front wall 141 as illustrated by the arrow 166 in FIG. 8. In this manner, the pawl 150 can be moved from the tensioned or locking position illustrated in FIG. 7 to a release position illustrated in FIG. 8, the teeth 115 on the strap 101 engaging the teeth on the pawl 150 to move the pawl 150 to the release position of FIG. 8. In this manner the cable tie 100 can be further tightened about the associated bundle 160 and may even be removed from therearound if the user will grasp the portion of the pawl 150 extending upwardly beyond the exit surface 130, thus to hold the pawl 150 out of engagement with the strap 101 to permit retrograde movement of the strap 101 through the frame 120.

Summarizing,, the cable tie 101 can be readily placed about an associated bundle 160 of wires 161. After tightening and strap severance, the pawl 150 and the associated parts more firmly grip and hold the strap 101, the pawl 150 being essentially disposed within the frame 120 with no part of the pawl 150 extending beyond the exit surface 130 of the frame 120. Furthermore, the frame 120 more closely lies against the bundle 160, all as illustrated in FIG. 7. If there is no strap severance after tightening, then the parts may be moved to the position illustrated in FIG. 8, thereby to release the strap 101 from the pawl 150 and to permit the user to grasp the pawl 150 to complete removal of the cable tie 100 from about the associated bundle 160.

In a constructional example of the cable tie 100 for use with bundles having a diameter of 1.75 inches, the overall length thereof is 7.5 inches, the width of the strap 101 is 0.180 inch, the length of the tip 103 is 1.225 inches, the portion of the strap carrying the teeth 115 has a length of 5.675 inches, the depth of the teeth 115 is 0.010 inch and the pitch thereof is 0.025 inch and the inclination of the surfaces 117 to the surface 112 is 22°, the dimensions of the frame 120 in the direction of the strap 101 is 0.250 inch, the overall height of the frame 120 is 0.165 inch, the overall width of the frame 120 is 0.320 inch, and the inclination of the several sides 123, 133 and 143 thereof is 2°, the surface 132 is inclined at an angle of 65° with respect to the entry surface 112 while the surface 135 is inclined at an angle of 30° with respect thereto, the thickness of the strap 101 is 0.040 inch, while the thickness of the hinge 118 is 0.035 inch, the sides of the pawl 150 converge at an angle of 2° with respect to the longitudinal axis of the throat normal to the entry surface 112, the upper end of the pawl 150 extends 0.030 inch above the exit surface 130 in the as-molded position thereof, and the hinge 151 has a thickness of 0.005 inch.

There is illustrated in FIGS. 9 to 11 of the drawings, a second embodiment of an integral one-piece cable tie made in accordance with the present invention, the cable tie of FIGS. 9 to 11 being generally designated by the numeral 200. Many of the parts of the cable tie 200 are identical in construction to the cable tie 100 described above, and accordingly, there has been applied to each part of the cable tie 200 a reference numeral in the 200 series corresponding to the reference numeral in the 100 series that was applied to the like part of the cable tie 100 described above.

The cable tie 200 includes a strap 201 having a pair of longitudinally extending strap sides 210, an inner bundle-engaging surface 212 and an outer surface 213. Disposed in the surface 212 is a row of teeth 215, the teeth 215 being disposed in a recessed position with respect to the surface 212 and each of the teeth 215 having a shorter side 216 disposed substantially normal to the adjacent surface 212 and a longer inclined side 217, see particularly FIG. 10.

A frame 220 is provided integral with the strap 201 and comprises a pair of side walls or members 221, a rear wall or member 231 and a front wall or member 241. As may be best seen in FIG. 11, the side walls 221 are laterally spaced apart and include inner surfaces 222 that extend the full height of the frame 220 and are disposed essentially parallel to one another, the inner surfaces 222 specifically extending from the inner surface or entry surface 212 of the frame 220 to an exit surface 230 on the top of the frame 220 as viewed in FIG. 11. The inner surfaces 222 further are spaced apart a distance slightly greater than the lateral distance between the strap sides 210, whereby the strap 201 may be received between the inner surfaces 222. Each of the side walls 221 further includes an outer surface 223 that extends downwardly from the exit surface 230 to the entry surface 212.

The rear wall or end wall 231 includes an inner surface 232 and an outer surface 233, the inner surface 232 diverging downwardly away from the outer surface 233 from the exit surface 230 toward the entry surface 212, whereby the rear wall 231 is thicker at the bottom thereof as illustrated in FIG. 10 than at the top thereof. The inner surface 232 has the outer edges thereof curved and joining with inwardly directed surfaces 224 on the side walls 220 (see FIG. 9), the upwardly directed surfaces 224 being divergent from one another toward the exit surface 230. A rounded surface 234 is provided at the lower portion of the rear wall 231 and merges with an upwardly inclined surface 235 on the lower portion of the rear wall 231. There further are provided upper guide surfaces or rails 236 which serve to direct the strap 201 along a predetermined path as will be explained more fully hereinafter.

The front wall or abutment wall 241 has an inner surface 242 that is spaced from the rear wall 231 in the direction opposite to the strap 201, the inner surface 242 being disposed substantially normal to the entry surface 212 and the longitudinal axis of the strap 201 as moldéd, and forming with the inner surface 232 a strap-receiving opening or throat 240. The front wall 241 also has an outer surface 243 which extends from a lower surface 245 upwardly to the exit surface 230. The surface 245 and the surfaces 222 cooperate to provide a strap-receiving channel through the head 220 and beneath the front wall 241. Rounded surfaces 246 join the surfaces 234 and 236 and serve as extensions of the rails 236 to guide the free end of the strap 201 into the proper position, a slightly inclined inner surface 247 being provided as indicated in FIGS. 10 and 11.

Mounted within the strap-receiving opening 240 in the frame 220 is a pawl 250, a hinge 251 of limited cross section and generally cylindrical as viewed in FIG. 11 serving integrally to interconnect the lower end of the pawl 250 to the rear wall 231 at the thicker portion thereof. The pawl 250 has a pair of side surfaces 252 that diverge slightly upwardly and converge toward one another in the direction of the strap 210 (see FIG. 9), and merge with a top surface 253 and a rear surface 254. The rear surface 254 is disposed toward the inner surface 232 and is shaped complementary thereto, while the surfaces 252 are disposed toward the surfaces 224 and are also shaped complementary with respect thereto. The surfaces 232 and 254 cooperate to provide sliding wedging surfaces that cooperate with one another during the tensioning of the cable tie 200 about an associated bundle.

A set of teeth 255 is provided on the surface of the pawl 250 disposed toward the inner surface 242, the teeth 255 each having a shorter side 256 and a longer inclined side 257. The shorter sides 256 are disposed substantially normal to the inner surface 242 and parallel to the entry surface 212 when in the as-molded condition as illustrated in FIG. 10. The crests of the teeth 255 are shaped convex and all lie on a common surface that is a section of a right cylinder; the roots of the teeth 255 also lie in a common surface that is a section of a right cylinder. The crest-to-crest distance on the pawl teeth 255 is slightly less than the crest-to-crest distance on the strap teeth 215, whereby all of the teeth 255 on the pawl 250 ultimately engage with the teeth 215 on the strap 201. The lateral extent of the teeth 255 is limited and front surfaces 258 are provided on each side of the teeth 255, the surfaces 258 lying substantially in the same plane as the surfaces 236 when the pawl 250 is in the as-molded condition thereof.

In use, the cable tie 200 is encircled about a bundle of wires and the free end of the strap 201 is inserted into the throat 240, the tip 203 being guided by the surfaces 234 and 235 and the strap 201 being guided by the rails 236 and the surfaces 246 into a position along the strap-bearing surface 242, initial engagement between the strap 201 and the pawl 250 being with the lowermost one of the teeth 255, i.e., the tooth 255 disposed toward the entry surface 212. Thereafter, the strap 201 may be tightened and otherwise manipulated as explained above with respect to the strap 101 of the cable tie 100.

There is illustrated in FIGS. 12 to 14 of the drawings a third embodiment of an integral one-piece cable tie made in accordance with the present invention, the cable tie of FIGS. 12 to 14 being generally designated by the numeral 300. Many of the parts of the cable tie 300 are identical in construction to the parts of the cable tie 100 described above, and accordingly, there has been applied to each part of the cable tie 300 a reference numeral in the 300 series like the reference numeral in the 100 series that was applied to the like part of the cable tie 100 described above. Certain aspects of the cable tie 300 are like those of the cable tie 200, and accordingly reference is also made to the disclosure of the cable tie 200.

The cable tie 300 includes a strap 301 having a pair of longitudinally extending strap sides 310, an inner bundle-engaging surface 312 and an outer surface 313. Disposed in the surface 312 is a row of teeth 315, the teeth 315 being disposed in a recessed position with respect to the surface 312 and each of the teeth 315 having a shorter side 316 disposed substantially normal to the adjacent surface 312 and a longer inclined side 317, see particularly FIG. 13.

A frame 320 is provided integral with the strap 301 and comprises a pair of side walls or members 321, a rear wall or member 331 and a front wall or member 341. The side walls 321 are laterally spaced apart and include inner surfaces 322 that extend the full height of the frame 320 and are disposed essentially parallel to one another, the inner surfaces 322 being spaced apart a distance slightly greater than the lateral distance between the strap sides 310, whereby the strap 301 may be received between the inner surfaces 322. Each of the side walls 321 further includes an outer surface 323.

The rear wall or end wall 331 includes an inner surface 332 and an outer surface 333, the inner surface 332 diverging downwardly away from the outer surface 333 from an exit surface 330 toward the entry surface 312, whereby the rear wall 331 is thicker at the bottom thereof as illustrated in FIG. 13 than at the top thereof. The inner surface 332 has the outer edges thereof curved and joining with inwardly directed surfaces 324 on the side walls 320 (see FIG. 12), the upwardly directed surfaces being divergent from one another toward the exit surface 330. An upwardly inclined guide surface 335 is provided on the lower portion of the rear wall 331 that serves to guide the free end of the strap 301 into the frame 320.

The front wall or abutment wall 341 has an inner surface 342 that is spaced from the rear wall 331 in the direction opposite to the strap 301, the inner surface 342 being disposed substantially normal to the entry surface 312 and the longitudinal axis of the strap 301 as molded, and forming with the inner surface 332 a strap-receiving opening 340. The front wall 341 also has an outer surface 333 which extends from a lower surface 345 upwardly to the exit surface 330, a curved surface 346 being provided at the juncture of the surfaces 343 and 345 and a curved surface 347 being provided at the juncture of the surfaces 342 and 345. The surface 345 and the side surfaces 322 cooperate to provide a strap-receiving channel through the head 320 and beneath the front wall 341.

Mounted within the strap-receiving opening 340 in the frame 320 is a pawl 350, a hinge 351 of limited cross section serving integrally to interconnect the lower end of the pawl 350 to the rear wall 331 at the thicker portion thereof. The pawl 350 has a pair of side surfaces 352 that diverge slightly upwardly and converge toward one another in the direction of the strap 310 (see FIG. 12), and merge with a top surface 353 and a rear surface 354 disposed toward the inner surface 332 and shaped complementary thereto; the side surfaces 352 are disposed toward the surfaces 324 and are also shaped complementary with respect thereto. The surfaces 332 and 354 cooperate to provide sliding wedging surfaces that cooperate with one another during the tensioning of the cable tie 300 about an associated bundle.

A set of teeth 355 is provided on the surface of the pawl 350 disposed toward the inner surface 342, the teeth 355 having a shorter side 356 and a longer side 357. The shorter sides 356 are disposed substantially normal to the inner surface 342 and parallel to the entry surface 312 when in the as-molded condition as illustrated in FIG. 13. The crests of the teeth 355 are shaped convex and all lie on a common surface that is a section of a right cylinder; the roots of the teeth 355 also lie in a common surface that is a section of a right cylinder. The crest-to-crest distance on the pawl teeth 355 is slightly less than the crest-to-crest distance on the strap teeth 315, whereby all of the teeth 355 on the pawl 350 ultimately engage with the teeth 315 on the strap 301 (see FIG. 14).

Also mounted on the front wall 342 in a recess 348 in the upper portion thereof is a tab 370 having a bearing surface 371 disposed toward the pawl 350 and extending beyond the adjacent inner surface 342 and having on the outer end thereof an outer surface 372. The tab 370 is flexible and can be deformed from the position illustrated in FIG. 13 to that illustrated in FIG. 14, the tab 370 serving to urge the adjacent portion of the strap 301 toward the pawl 350.

In use, the cable tie 300 is encircled about a bundle 360 of wires 361 (see FIG. 14) and the free end of the strap 301 is inserted into the throat 340, the strap 301 being guided into the proper position by the surfaces 335 and 345. The tab 370 serves to urge the free end of the strap 301 into engagement with the pawl 350, the parts being in the position illustrated in FIG. 14 in the tensioned condition thereof; it will be noted that the tab 370 is deformed into a position such that the bearing surface 371 thereof is essentially in alignment with the surface 342.

There is illustrated in FIGS. 15 to 17 of the drawings a fourth embodiment of an integral one-piece cable tie made in accordance with the present invention, the cable tie of FIGS. 15 to 17 being generally designated by the numeral 400. Many of the parts of the cable tie 400 are identical in construction to the parts of the cable tie 100 described above, and accordingly, there has been applied to each part of the cable tie 400 a reference numeral in the 400 series like the reference numeral in the 100 series that was applied to the like part of the cable tie 100 described above.

The fundamental difference between the cable ties 100 and 400 resides in the size of the pawls 150 and 450, respectively, the pawl 450 having a substantially smaller vertical extent as viewed in FIGS. 15 and 16 than does the pawl 150 as viewed in FIGS. 3 and 4. More specifically, the pawl 450 as molded is completely disposed within the head 420 (see FIGS. 15 and 16), and the pawl 450 is disposed within the head 420 and between the entry surface 412 and the exit surface 430 thereof in all positions of the pawl including the as-molded position thereof and the tensioned position thereof. In all other respects, the cable tie 400 of FIGS. 15 to 17 is identical in construction to the cable tie 100 of FIGS. 1 to 8.

There is illustrated in FIGS. 18 to 21 of the drawings, a fifth embodiment of an integral one-piece cable tie made in accordance with the present invention, the cable tie of FIGS. 18 to 21 being generally designated by the numeral 500. Certain of the parts of the cable tie 500 are identical in construction to the parts of the cable tie 100 described above, and, accordingly, there has been applied to each part of the cable tie 500 a reference numeral in the 500 series like the reference numeral in the 100 series that was applied to the like part of the cable tie 100 described above.

The cable tie 500 includes a strap 501 having a pair of longitudinally extending strap sides 510, an inner bundle-engaging surface 512 and an outer surface 513. Disposed in the outer surface 513 is a row of teeth 515, the teeth 515 being disposed in a recessed position with respect to the surface 513 and each of the teeth 515 having a shorter side 516 disposed substantially normal to the adjacent surface 513 and a longer inclined side 517, see also FIG. 19. A frame 520 is provided integral with the strap 501 and comprises a pair of side walls or members 521, a rear wall or member 531, and a front wall or member 541. The side walls 521 are laterally spaced apart and include inner surfaces 522 that extend the full height of the frame 520 and are disposed essentially parallel to one another, the inner surfaces 522 being spaced apart a distance slightly greater than the lateral distance between the strap sides 510, whereby the strap 501 may be received between the inner surfaces 522. Each of the side walls 522 also includes an outer surface 523.

The rear wall or end wall 531 includes an inner surface 532 and an outer surface 533, the inner surface 532 diverging downwardly away from the outer surface 533 from an exit surface 530 toward the entry surface 512, whereby the rear wall 531 is thicker at the bottom thereof as illustrated in FIG. 19 than at the top thereof. The inner surface 532 merges with a vertically positioned stop surface 534 that in turn merges with a guide surface 535 spaced from and disposed substantially parallel to the entry surface 512 and extending between the outer surface 533 and the stop surface 534. The surface 545 and the side surfaces 522 cooperate to provide a strap-receiving channel through the head 520 and beneath the end wall 531. Also provided on the end wall 531 is a pair of laterally spaced apart rails 536 disposed against the inner surfaces 522 of the side walls 521 and being formed substantially rectangular and in block form including inwardly facing surfaces 537 and forwardly facing surfaces 538 disposed toward the strap 501.

The front wall or abutment wall 541 has an inner surface 542 that is spaced from the rear wall 531 in the direction of the strap 501, the abutment wall 541 being directly connected to and integral with the strap 501, the inner surface 542 being disposed substantially normal to the entry surface 512 and the longitudinal axis of the strap 501 as molded. The inner surface 542 cooperates with the surface 532 to form a strap-receiving opening 540 through the head 520. The front wall 541 also has an outer surface 543 that extends from the entry surface 512 to the exit surface 530, a curved lower surface 545 being provided at the juncture of the inner surface 542 with the entry surface 512.

Mounted within the strap-receiving opening 545 in the frame 520 is a pawl 550, a hinge 551 of limited cross section serving integrally to interconnect the lower end of the pawl 550 to the rear wall 531 at the thicker portion thereof. The pawl 550 has a pair of side surfaces 552 that are disposed substantially parallel one to the other and merge with a top surface 553 and a rear surface 554 that is disposed toward the inner surface 532 and is shaped complementary thereto. The surfaces 532 and 554 cooperate to provide sliding wedging surfaces that cooperate with one another during the tensioning of the cable tie 500 about an associated bundle 560.

A set of teeth 555 is provided on the surface of the pawl 550 disposed toward the inner surface 542, the teeth 555 having a shorter side 556 and a longer inclined side 557. The shorter sides 556 are disposed substantially normal to the inner surface 542 and parallel to the entry surface 512 when in the as-molded condition as illustrated in FIG. 19. The crests of the teeth 555 all lie in a common plane that is parallel to the inner surface 542, and the roots of the teeth 555 also lie in a common plane that is parallel to the inner surface 542. The crest-to-crest distance on the pawl teeth 555 is slightly less than the crest-to-crest distance on the strap teeth 515, whereby all of the teeth 555 on the pawl 550 ultimately engage the teeth 515 on the strap 501, see FIG. 21.

In use the cable tie 500 is encircled about a bundle 560 of wires 561 and the free end of the strap 501 is inserted into the throat 540 and is guided by the surface 545 and the rails 536 into a position adjacent to the strap-bearing surface 542, the initial engagement between the strap 501 and the pawl 550 being with the lowermost one of the teeth 555, i.e., the tooth 555 disposed toward the entry surface 512. Thereafter, the strap 501 is tightened and otherwise manipulated as explained above with respect to the strap 101 of the cable tie 100. During the retrograde movement of the parts to the position illustrated in FIG. 21, it is pointed out that the hinge 551 is limited in the amount of rotation to which it can be subjected, i.e., the movement toward the entry surface 512 is limited by the stop surface 534 on the end wall 531.

From the above, it will be seen that there have been provided improved cable ties which fulfill all of the objects and advantages set forth above.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an abutment wall, said frame having an entry surface and an exit surface and a strap-receiving opening extending therethrough, a pawl disposed within said frame in said strap-receiving opening, a wedging surface on said frame opposite said abutment wall and a wedging surface on said pawl disposed adjacent to said frame wedging surface, a hinge interconnecting said frame and the end of said pawl disposed toward said entry surface, the thickness of said hinge being less than the thickness of said strap to accommodate ready movement of said pawl with respect to said frame, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said hinge and said wedging surfaces being arranged to accommodate sliding movement of said pawl toward said entry surface with said wedging surfaces in contact thereby to move said tooth toward said strap-bearing surface, said strap being deformable into a loop encircling a bundle of wires with the other end of said strap extending into said strap-receiving throat and through the opening in said frame and therebeyond, said tooth being disposed toward said row of abutments as said strap is tightened about a bundle of wires to a tensioned condition and release of said strap causing at least one of said abutments firmly to engage said tooth, any force tending to withdraw said strap from within said strap-receiving throat in a strap-loosening direction serving to move said pawl along said frame wedging surface toward said entry surface to move said tooth into more firm engagement with the engaged ones of said row of abutments firmly to wedge said strap between said strap-bearing surface and said pawl, whereby to prevent inadvertent withdrawal of said strap from said frame and thus to lock said strap in its tensioned condition about the bundle.

2. The integral one-piece cable tie set forth in claim 1, wherein said wedging surfaces are substantially planar.

3. The integral one-piece cable tie set forth in claim 1, wherein said frame wedging surface is concave and said pawl wedging surface is convex and shaped complementary to said frame wedging surface.

4. An integral one-piece cable tie to be tensioned about a handle of wires and the like, said cable tie comprising an elongated flexible strap, a row of abutments disposed on one longitudinal surface of said strap and arranged transversely with respect thereto, a frame integral with one end of said strap and including an abutment wall, said frame having an entry surface and an exit surface and a strap-receiving opening extending therethrough, a pawl disposed within said frame in said strap-receiving opening, a hinge interconnecting said frame and the end of said pawl disposed toward said entry surface, the thickness of said hinge being less than the thickness of said strap to accommodate ready movement of said pawl with respect to said frame, a stop integral with said frame adjacent to the juncture of said hinge therewith and limiting movement of said hinge in a direction toward said entry surface, said abutment wall having a strap-bearing surface disposed toward said pawl and defining therewith a strap-receiving throat, and a tooth on said pawl arranged transversely with respect thereto and disposed toward said abutment wall and shaped to engage said row of abutments on said strap, said strap being deformable into a loop encircling a bundle of wires with the other end of said strap extending into said strap-receiving throat and through the opening in said frame and therebeyond, said tooth being disposed toward said row of abutments as said strap is tightened about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

5. The integral one-piece cable tie set forth in claim 4, wherein said stop is disposed substantially normal to said entry surface and immediately below the connection between said hinge and said frame.

6. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an abutment wall, said frame having an entry surface and an exit surface and a strap-receiving opening extending therethrough, a pawl disposed within said frame in said strap-receiving opening, a hinge interconnecting said frame and the end of said pawl disposed toward said entry surface, said abutment wall having a strap-bearing surface disposed toward said pawl and defining therewith a strap-receiving throat, a tooth on said pawl arranged transversely with respect thereto and disposed toward said abutment wall and shaped to engage said row of abutments on said strap, and a tab on said abutment wall adjacent to said exit surface extending toward said pawl, said strap being deformable into a loop encircling a bundle of wires with the other end of said strap extending into said strap-receiving throat and through the opening in said frame and therebeyond, said tooth being disposed toward said row of abutments as said strap is tightened about the bundle of wires to a tensioned condition and release of said strap causing at least one of said abutments firmly to engage said tooth, said tab urging the portion of the strap between said strap-bearing surface and said pawl into engagement with said pawl, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawl of said strap from said frame and thus to lock said strap in its tensioned condition about the bundle of wires.

7. The integral one-piece cable tie set forth in claim 6, wherein said tab is deformable upon engagement with said strap to a position such that the surface thereof disposed toward said strap is substantially flush with said strap-bearing surface.

8. An integral one-piece cable tie to be tensioned about a bundle of wires and the like, said cable tie comprising an elongated flexible strap, a row of abutments disposed on one longitudinal surface of said strap and arranged transversely with respect thereto, a frame integral with one end of said strap and including an end wall and an abutment wall, said frame having an entry surface and an exit surface and a strap-receiving opening extending therethrough, a pawl disposed within said frame in said strap-receiving opening and pivotally mounted on and integral with said frame, said abutment wall having a strap-bearing surface disposed toward said pawl and defining therewith a strap-receiving throat, a tooth on said pawl arranged transversely with respect thereto and disposed toward said abutment wall and shaped to engage said row of abutments on said strap, said strap being deformable into a loop encircling a bundle of wires with the free end of said strap extending into said strap-receiving throat and through the opening in said frame and therebeyond, and a plurality of gripping projections on said strap at the free end thereof for engagement by a user during application of said cable tie about a bundle of wires, said gripping projections being disposed on said one longitudinal surface of said strap and laterally toward the edges thereof so as to pass laterally to the side of said tooth when said free strap end is inserted into the strap-receiving throat, said tooth being disposed toward said row of abutments as said strap is tensioned about the bundle of wires to a tensioned condition and release of said strap causing at least one of said abutments firmly to engage said tooth, any force tending to withdraw said strap from within said strap-receiving throat in a strap-loosening direction serving to move said tooth into more firm engagement with the engaged ones of said row of abutments firmly to grip said strap between said strap-bearing surface and said pawl, whereby to prevent inadvertent withdrawal of said strap from said frame and thus to lock said strap in its tensioned condition about the bundle of wires.

9. The integral one-piece cable tie set forth in claim 8, wherein said gripping projections are arranged in two longitudinally disposed rows on said one longitudinal surface of said strap, said rows of gripping projections being laterally spaced apart a distance greater than the lateral width of said tooth.

* * * * *